US005887552A

United States Patent [19]

Luraghi

[11] Patent Number: 5,887,552

[45] Date of Patent: Mar. 30, 1999

[54] FLUID HEAT GENERATOR, WITH SELECTIVE CONTROL OF THE FLOW

[75] Inventor: Vladimiro Luraghi, Brugherio, Italy

[73] Assignee: Bono Energia S.P.A., Peschiera Borromeo, Italy

[21] Appl. No.: 941,574

[22] Filed: Sep. 30, 1997

[30] Foreign Application Priority Data

Oct. 4, 1996 [IT] Italy ..... MI96A2060

[51] Int. Cl.[6] ..... F22B 23/06

[52] U.S. Cl. ..... 122/367.3; 122/406.1

[58] Field of Search ..... 122/367.1, 367.2, 122/367.3, 406.1

[56] References Cited

U.S. PATENT DOCUMENTS

| | | | |
|---|---|---|---|
| 4,095,563 | 6/1978 | Finger | 122/235 R |
| 4,196,700 | 4/1980 | Keseru et al. | 122/406.1 |
| 4,546,731 | 10/1985 | Ammann | 122/367.3 |
| 5,341,769 | 8/1994 | Ueno et al. | 122/367.3 |
| 5,566,648 | 10/1996 | Fenn et al. | 122/367.3 |

*Primary Examiner*—Teresa Walberg
*Assistant Examiner*—Gregory A. Wilson
*Attorney, Agent, or Firm*—Pillsbury Madison & Sutro

[57] ABSTRACT

The diathermic fluid heat generator comprises a plurality of pipe nests for fluid circulation, which define the internal walls of a combustion chamber, where the diathermic fluid is heated directly by radiation; and at least a pipe nest in a conveying path for the combustion gas, where the fluid is heated in countercurrent by convection. A fluid distributing header unit comprises an inlet header section, an outlet header section and a main header section having an annular form, positioned at the front side of the combustion chamber. The pipe nest of the gas conveying path is connected in series to the pipe nests of the combustion chamber, by the main header section. Moreover temperature and pressure control means are provided for controlling the fluid circulation; the control means comprise a temperature and pressure detecting device in each section of the fluid distributing header, and an electronic control unit fed by temperature and/or pressure control signals generated by each detecting device to monitor and control the generator operation.

17 Claims, 6 Drawing Sheets

FLUID HEAT GENERATOR, WITH SELECTIVE CONTROL OF THE FLOW

BACKGROUND OF THE INVENTION

The present invention refers to a diathermic fluid heat generator, also said pipe nest heating furnace, of the type described in the preamble of claim 1, by which it is possible to carry out a selective control of the thermal fluid circulation to detect the starting of possible cracking phenomena or unusual operating conditions.

In several fields, in particular in the production of synthetic fibres and yarns, it is required to dispose of large quantities of thermal energy at high temperature, maintaining low operating pressures of the plant for safety as well as for management economy reasons.

It is also known that some type of synthetic oils, more generally known as diathermic oils, used as heat transfer fluid, even at temperatures in the range of some hundreds of degrees, have a very low vapour pressure, typically of some bars, with respect to pressure values which are remarkably higher than the steam used as thermal fluid for heat transfer.

PRIOR ART

Presently, the conventional diathermic fluid heating furnaces are constituted by a limited numbers of tubular coils, having a parallel path within a cylindrical shell which in most cases results to be vertically arranged.

Thermal fluid heating furnaces are known from German publication DE-A-1.451.289 and French publication FR-A-2.274.877, which comprise a front header or manifold unit to connect a plurality of fluid circulation pipe nests, defining the walls of a combustion chamber, as well as a plurality of pipes heated by convection, arranged in a circulation path for the combustion gas; however each convection heated pipe constitutes a direct extension of a corresponding pipe of the combustion chamber which is heated by radiation from the burner flame: that is the pipe nests of the combustion chamber and the convection bank are not functionally separated from the diathermic fluid circulation point of view.

In these conventional furnaces, the signalling of working irregularities in the diathermic fluid circulation, is obtained as a simple flow indication only which, in case of vertical coil furnaces mainly employed in the filed of synthetic fibres production, necessarily requires the installation of a flow meter for each coil. Such a signalling is necessary as the tubular design in these furnaces is intrinsically non-homogeneous under all aspects, both as to the length of the pipes or coils, and to their thermal exposition to the flame and as to the thermal load to which every tubular element of the furnace is subjected to. Therefore thermally unbalanced conditions are likely to occur which can cause dangerous operating situations, with possible formation of obstructions to the flow because of the well known cracking phenomenon.

It is also to be considered that in these conventional furnaces it is quite difficult to visualise the coil overheating areas and adjust the direction of the flame accordingly: that is to intervene in order to prevent diathermic oil cracking.

This is due to the fact that the coils turn all together in the same positions of the combustion chamber and a flame distortion causes the contemporaneous overheating in the same area.

It is also difficult to find out on the coils the positions where possible obstructions cause rapid pressure drops.

In practice, in the conventional coil generators any system to control the arising of any operating fault, is blind.

OBJECT OF THE INVENTION

An object of the present invention is to provide a pipe nest heating furnace or more generally a diathermic fluid heat generator which is provided with a selective control of the fluid circulation conditions and of any possible cracking phenomena in each single pipe delimiting the combustion chamber, by identifying the pipe nest of the furnace and the position where said phenomenon is occurring, to allow possible corrective interventions of the combustion, or to simplify reparation thereof.

The structure of the furnace presents an external shell or casing having substantially a parallelepiped shape, entirely welded and of strong sturdiness. The furnace comprises an inlet header, an outlet header and a main front header, of annular form, divided in sections by a set of internal partitions which allow for the connection in series both of the various pipe nests heated by radiation which are defining and screening the combustion chamber, and the pipe nests heated by convection in a countercurrent direction of the combustion gas conveyed toward an air preheater, said convection pipe nests being in turn connected in series to the combustion chamber pipe nests, through a section of the front header.

According to an preferred embodiment, that will be described in detail hereinafter, the pipe nests constituting the roof wall, the rear wall and the bottom wall of the combustion chamber are related to respective horizontal sections of the front header, while the pipe nests of the side walls and back screening of the furnace, are connected to respective vertical sections of the main header. The roof and bottom pipes are suitable offset and differently shaped in the rear part of the combustion chamber for allowing the passage of the combustion gas from the combustion chamber to the convention heating area.

In this area, the pipe system comprises pipe nests differently bent in the U-shape, transversally to the gas flow, parallelly connected between the inlet section and an intermediate section of the front header. The diathermic fluid circulation in these pipes occurs in countercurrent conditions to the hot gas flowing from the combustion chamber toward the air preheater. The pipes of the convection nest are overlapped among them alternatively in an offset mode, in such a way that each pipe leans, in the bending portion thereof, on the underlying pipes, thus resulting in a self-supporting pipe nest system.

The convection pipe nest section is always functionally separated from the combustion chamber pipe nest section. Therefore there is the possibility of varying and controlling the diathermic fluid speed in the two pipe sections assuring the following two advantages:

1. Best cooling of the pipes which are more exposed to heat (combustion chamber) providing for higher speeds of the diathermic fluid even if thus causing higher load losses;
2. Total load losses of the generator however reduced within acceptable values by decreasing the speed of the fluid in the areas at low temperature of the combustion gas (convection area).

The inlet and outlet headers may be integrated in the "O"-shaped front header, which distributes the oil in the various circuits of the combustion chamber. It is therefore provided a "A"-shaped header assembly, constituting a very compact structure having the convection pipe nests which may be arranged in a low, upper or side position with respect to the combustion chamber.

Moreover, it is possible to maintain the same operative philosophy of the generator, but providing the inlet and outlet headers in a position physically separated from the "O" front header in all cases where the application makes it convenient.

To simplify:

positioning of the convection pipe nests over the combustion chamber, always keeping its inlet/outlet headers integrated into the front header, seems to be more convenient in large capacity furnaces for a more accessibility to the burner and to the windows for observing the flame without too many stairs and service platforms;

positioning of the convection pipe nest separated from the combustion chamber and with the inlet/outlet headers spaced apart, not structurally integrated in the front header, is considered convenient in heat generators using coal dusts and with a high percentage of ash to carry out the deviations of the combustion gas path necessary to the separation of the ash itself.

According to a further feature of the invention, the air preheater is built-in in the furnace structure and it is provided by a set of smoke-pipes to simplify the cleaning operation, meanwhile increasing the heat generator efficiency.

This particular arrangement and design of the front header as well as the particular disposition and connection in series of the pipe nests for diathermic fluid circulation, provide several advantages, among them a favourable designing and calculation of the furnace which, being equal the general thermal capacity and the specific thermal load of the combustion chamber, allows for the reduction of the height of the generator with respect to the conventional coil systems for which there is a limit value of the coil diameter, for example, imposed by installation and transport reasons.

The front arrangement of the main header and the structural and functional independency of the pipe nests, allow for a free expandability, both with respect to the single fastening point of the pipes provided by the same header, and for the total thermal independency of the direct heating pipe nests, radiated by the flame into the combustion chamber, with respect to the convection pipes by which it is possible to recover a great part of the heat transported by the combustion or flue gas.

Therefore the furnace according to the invention comprises a compact structure which is also extremely sturdy and can be supplied ready for installation.

The diathermic fluid re-mixing in the various header sections, disposed between circuit pipes connected in series and functionally independent among them, leads to flatten the rising profile of the temperature curve, thus creating a more homogeneous and functionally safe situation for the whole heat generator.

According to the invention, this allows for the use of a suitable integrated system for monitoring the fluid circulation conditions in each of the pipe nests defining the combustion chamber and in the convection area. In fact, thanks to the possibility of installing suitable temperature and pressure sensing means and devices in each section of the front header as well as in the fluid inlet and outlet headers, it will be possible to survey the regular circulation of the diathermic fluid in the several circuits in series, by simply detecting suitable differential pressure and/or temperature control signals.

By means of a suitable process unity programmed for monitoring and controlling the working conditions inside the furnace, it will be therefore possible to detect in real time, and also to prevent, dangerous resistance or obstructions to the thermal fluid flow, caused by local overheating of some pipes of the pipe nests defining the combustion chamber, and by the subsequent cracking of the circulating fluid. It will be also possible to localize the overheating position by identifying the header sections between which the obstructions are occurring, changing, where requested, the irregular orientation of the flame which caused said overheating. The oil circulation in the combustion chamber has been in fact designed to allow for detecting this incorrect orientation of the flame. Alternatively, alarm systems can be provided to stop or shutdown the furnace operation, or to allow maintenance or substitution of the plugged pipes or of the pipes which are going to collapse or break down.

Generally, therefore, an object of the present invention is to provide a diathermic fluid heat generator comprising a particular fluid circulation system which allows for the use of a fluid monitoring technique able to overcome to the previously referred inconveniences.

Some researches carried out by using a suitable simulator, have in fact demonstrated that the multi-tubular structure of the header according to the invention, is optimally fitted to take advantage from this control system. Moreover by combining in the header sections the use of temperature and pressure sensing devices, there is the possibility of previously detecting not only the formation of resistance or obstructions caused by for diathermic fluid cracking, but above all the presence of localized overheating of the combustion chamber which constitutes the main cause of faults.

In this way precautionary interventions, alarms, or other kind of information can be all activated by a dedicated control software.

BRIEF DESCRIPTION OF THE DRAWINGS

The heat generator according to the present invention will be described in detail hereinafter, with reference to the accompanying drawings, in which.

DETAILED DESCRIPTION OF THE INVENTION

With reference to the several figures, hereinafter we will describe in detail a preferred embodiment of the diathermic fluid furnace or heat generator according to the invention; in particular the embodiment will be described in which a front header having an "A" shape is used and a convection pipe nest is positioned under the combustion chamber.

Figure 1:
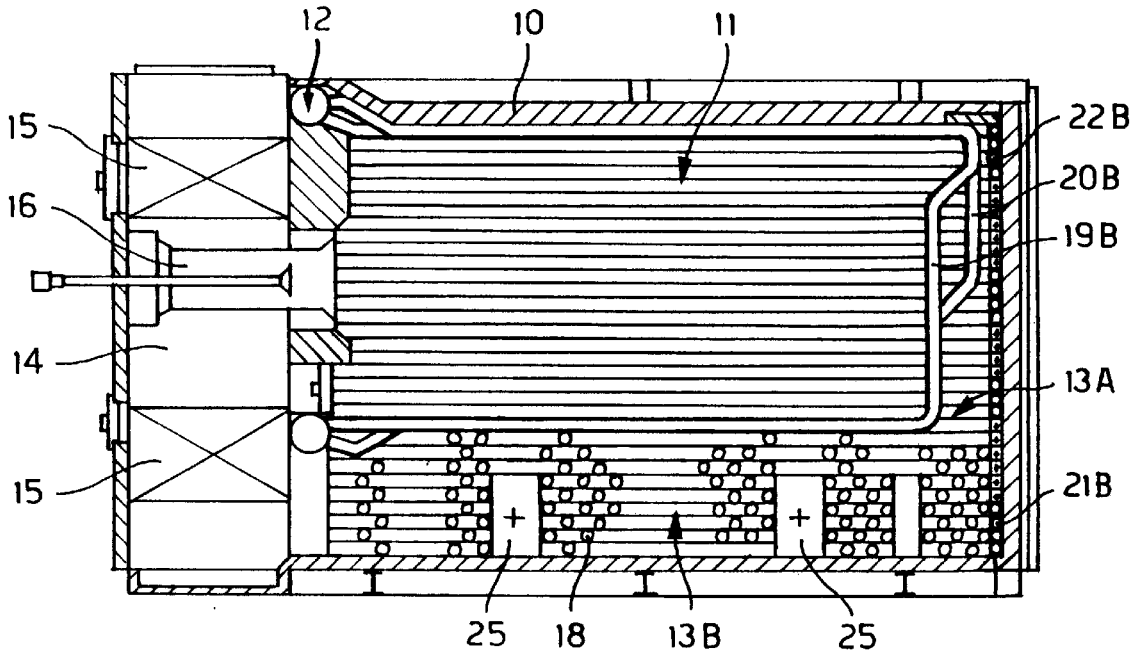
FIG. 1 is a longitudinal sectional view of the heat generator with the convection pipe nest positioned under the combustion chamber.

As shown in FIG. 1, the furnace substantially comprises a shell 10 having a parallelepiped shape, suitably heat insulated by a panelling and entirely welded to provide for a strong sturdiness; a combustion chamber 11 has been provided in the upper part of the furnace, which is completely screened by a plurality of tangent pipes suitably connected to several sections of a combined header 12, having a characteristic portal arrangement on the front side of the furnace.

Rearwardly and underneath the combustion chamber 11, a path 13A, 13B has been obtained for the combustion or flue gas, said path opening into an air preheater 14 built-in in the front part of the same furnace structure; the air preheater 14 comprises, for example, two smoke-pipe banks 15 vertically arranged to simplify the cleaning operation. Reference number 16 in FIG. 1 lastly refers to the burner of the furnace.

As previously referred, the large combustion chamber 11 is entirely screened by tangent pipe nests, defining the heating area of the thermal fluid by direct radiation of the burner flame; the pipes of the combustion chamber, in this example, are grouped in four pipe nests connected in series among them by corresponding sections of the header 12, respectively are connected in series, by a specific section of the same header, to the convection pipe nest positioned in the path 13B of the flue gas directed toward the air preheater 14 and leaving from a stack.

With reference now to FIGS. from 1 to 9, we will describe the design and the arrangement of the different pipe nests defining the walls of the combustion chamber 11, the back screening wall for the shell of the furnace, and the convection pipe nest in the path 13B of the flue gas, as described in the following.

Figure 2:
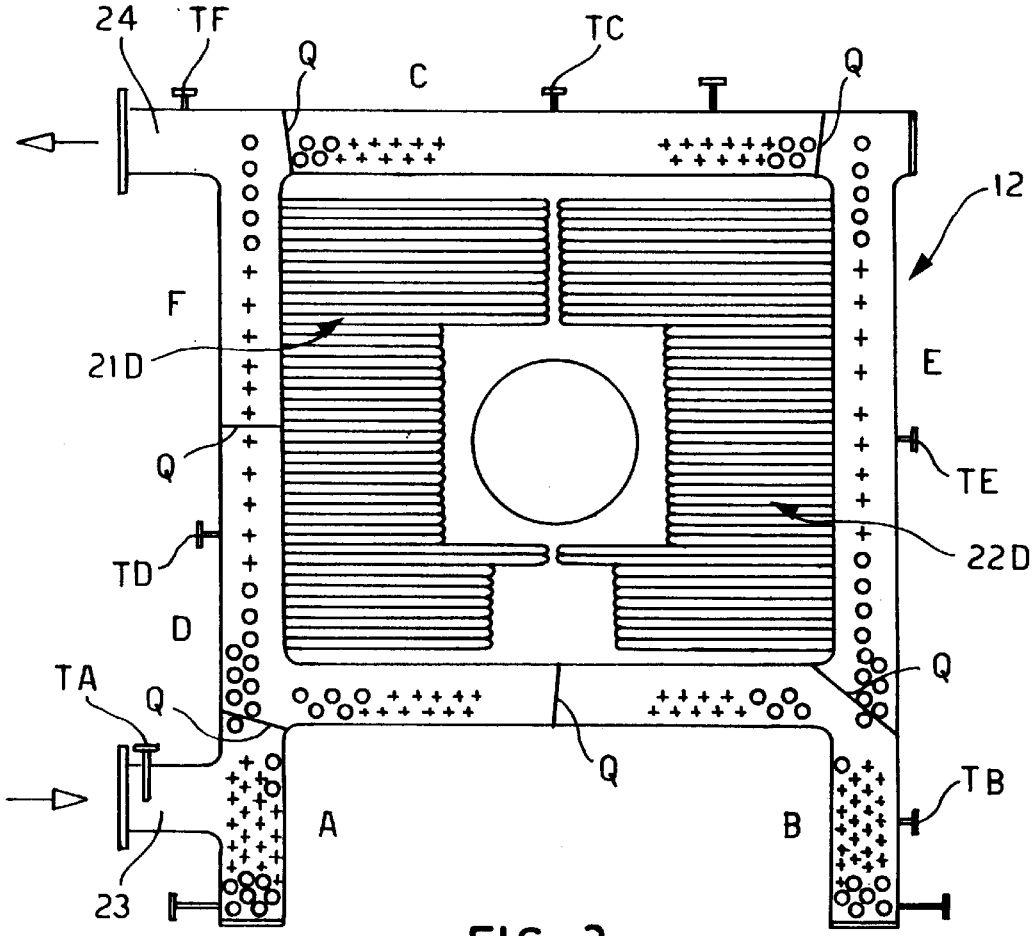
FIG. 2 is en enlarged view of the front header for the heat generator of FIG. 1.

The header 12 is shown in the particular example of FIG. 2; as it can be seen, the header 12 is constituted by a tubular structure which is divided, by suitable internal partitions Q, into six header sections indicated by the capital letters A, B, C, D, E and F. More precisely, sections B, C, D and E define the main header for the combustion chamber pipe nests, while sections A and F define respectively an inlet header and an outlet header, structurally integrated in a combined header of portal shape.

The different header sections have one or more rows of holes for the connection to the pipe nests according to the schemes shown in FIGS. from 5 to 9; in particular, section A provided with the inlet fitting 23, section F provided with the outlet fitting 24 and part of section D at one side, as well as section E and part of section B on the other side, define the vertical portions of the header 12; otherwise, the remaining of sections B and D and section C define the horizontal portions of the header, in its typical portal or "A" shape.

The pipe system screening the combustion chamber 11, comprises a first pipe nest 19 between the header sections B and C, and a second pipe nest 20 between the header section C and D arranged in vertical planes; the pipes of the first nest 19 co-operate with the pipes of the second nest 20 in defining the roof (19A, 20A), the rear (19B, 20B) and the bottom walls (19C, 20C) of the combustion chamber.

The pipe system screening the combustion chamber comprises two additional pipe nests 21 and 22 arranged in horizontal planes, which are connected to the header D, E and E, F to define the side walls (21A, 22A; 21C, 22C) of the combustion chamber, as well as the back screening by an intermediate length 21B and 22B of each pipe of the two pipe nests 21 and 22.

The two pipe nests 21 and 22 comprise moreover front length 21D and 22D which are inwardly bent to define a front screening portion of the combustion chamber in the header plane, surrounding the burner.

Figure 5:
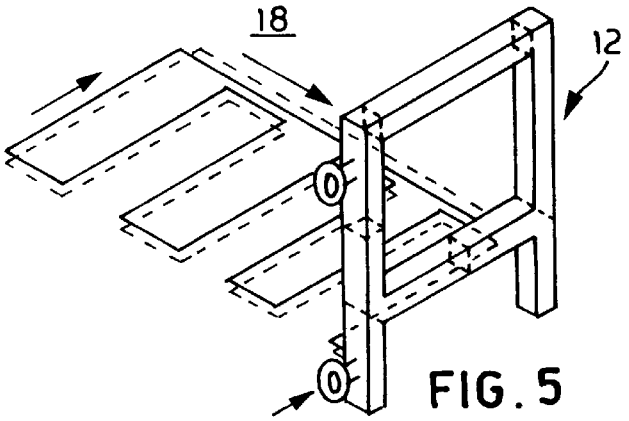
FIG. 5 shows a typical arrangement of the convection pipe nest.
Figure 6:
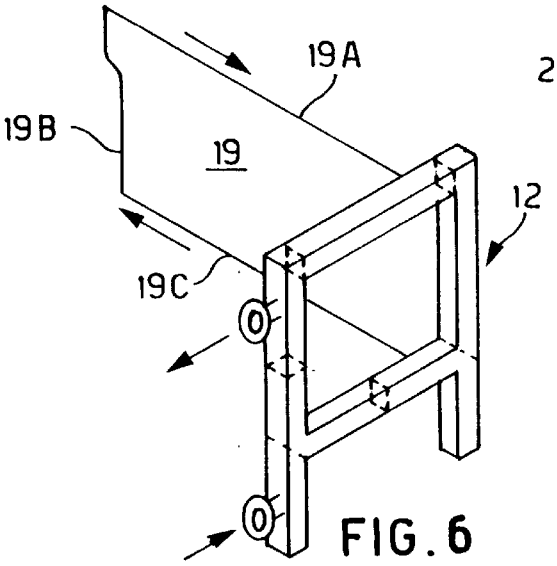
FIGS. 6 and 7 show the arrangement of the pipes constituting the roof, rear and bottom walls of the combustion chamber.
Figure 7:
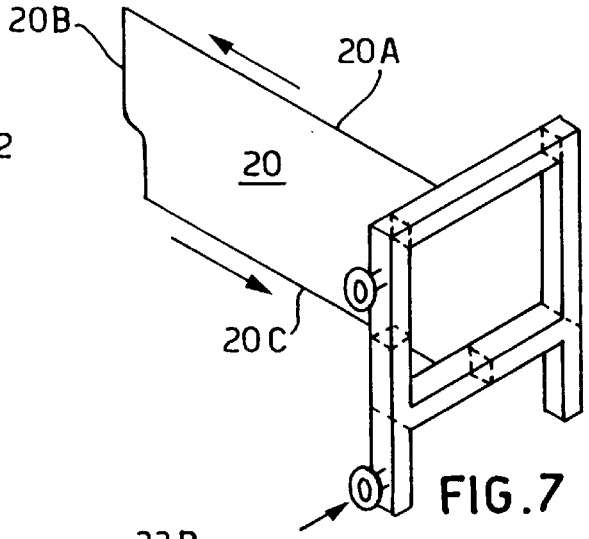
Figure 8:
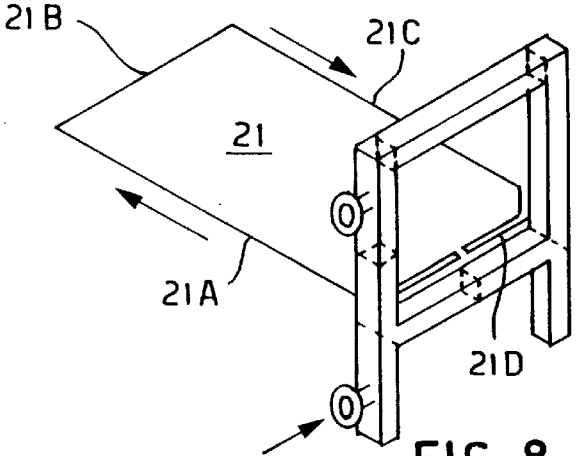
FIGS. 8 and 9 show the arrangement of the pipes constituting the side walls of the combustion chamber and the back wall for screening the flue gas path.
Figure 9:
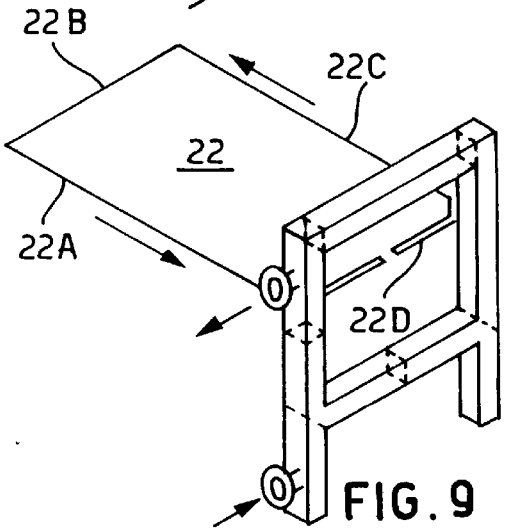

On the contrary, FIG. 5 shows the particular looped disposition and the self-supporting arrangement of the overlapping pipes of the convection pipe nest 18, positioned in the flue gas path 13B, which connect inlet section A of the header with the first intermediate section B, as shown.

This particular front arrangement of the header 12 n combination with a particular tubular path for the diathermic fluid defining side by side arranged pipe nests for each wall of the combustion chamber, in which the diathermic fluid is reversely flowing from and to the front header, allows for several advantages which can be listed in a favourable designing and calculation of the furnace structure which, being equal the general thermal capacity and the specific thermal load of the combustion chamber, allows for the reduction of the height dimension; moreover the front arrangement of the header 12 from which the pipes are welded, are departing and coming back, both in the radiation and in the convection circuits of the pipe nests, allows for a free expansion of the whole pipe system. In this way the pipe system is not subjected to any mechanical stress in the welding points to the header 12. Lastly, the disposition of the convection pipe nest under the combustion chamber and their horizontal coil design having "U" bent loops, suitably offset among them, make the whole pipe nest self-supporting. The heat generator therefore has a compact design particularly suitable for being pre-assembled and supplied ready for installation. In at least one intermediate area of the convection nest, a vertical rank of coils may be omitted or the coils may be suitably spaced apart to create a room 25 with an inlet opening for the pipe nest cleaning. Furthermore, the connection in series of the convection pipe nest 18 to the pipe nest of the combustion chamber, being equal the flow, allows for different flow speeds, in differently heated areas by varying the total section of the fluid passages, for example maintaining the same speed at sufficiently high values in the pipe of the combustion chamber to reduce cracking risk, on the contrary reducing the same in the pipes heated by convection from the flue gas where there is a minor thermal rise.

The diathermic fluid path is easy to guess and it is represented by the arrows in FIGS. from 4 to 9. In particular, the diathermic fluid enters from inlet fittings 23 of the first lower section A and, after flowing along the convection nest 18, comes into the vertical part of header section B after thermally exchanging in countercurrent with the flue gas flowing along the path length 13B.

In the vertical side of section B of the header, the diathermic fluid is remixed and then flows toward the horizontal length and hence gets into in the pipe nest 19 between sections B and C of the header, flowing for a length of the bottom 19C, the length 19B of the rear part of the combustion chamber, as well as the length 19A of the roof, to be discharged into the horizontal section C. The fluid already partially heated, flows in the section C of header where it is remixed again to proceed then along the pipe nest 20 flowing along the remaining part of the roof 20A, the rear part 20B and the remaining part of the bottom wall 20C of the combustion chamber, between header sections C and D. Successively the fluid enters the horizontal part of the header section D flowing toward the vertical one of the same section, along pipe nest 21 between the sections D and E of the header defining the lower part of the side walls 21A, 21C, as well as the lower part of the screening back wall 21B. Therefore from the vertical section E of the header the diathermic fluid flows toward the last header section F and toward the outlet fitting 24, flowing along the horizontal pipe nest 22 which delimit the remaining upper part of the side walls 22A, 22C of the combustion chamber, as well as the remaining upper part 22B of the screening back wall.

Therefore the overall system is constituted by a path in the convection pipe nest 18, followed by four paths in series, 19, 20, 21, 22 for the roof, the bottom and the two side walls, the rear wall of the combustion chamber and the back screening wall.

In turn the gas leaving the combustion chamber passes through the offset pipes 19B and 20B of the rear wall of, after licking pipes 21B and 22B screening the back wall of the furnace, flows along path 13B toward the air preheater 14, in countercurrent to the thermal fluid flow. The gas coming from the convection path enters the bottom part of the front air preheater 14 going through the same up to the stack.

Figure 3:
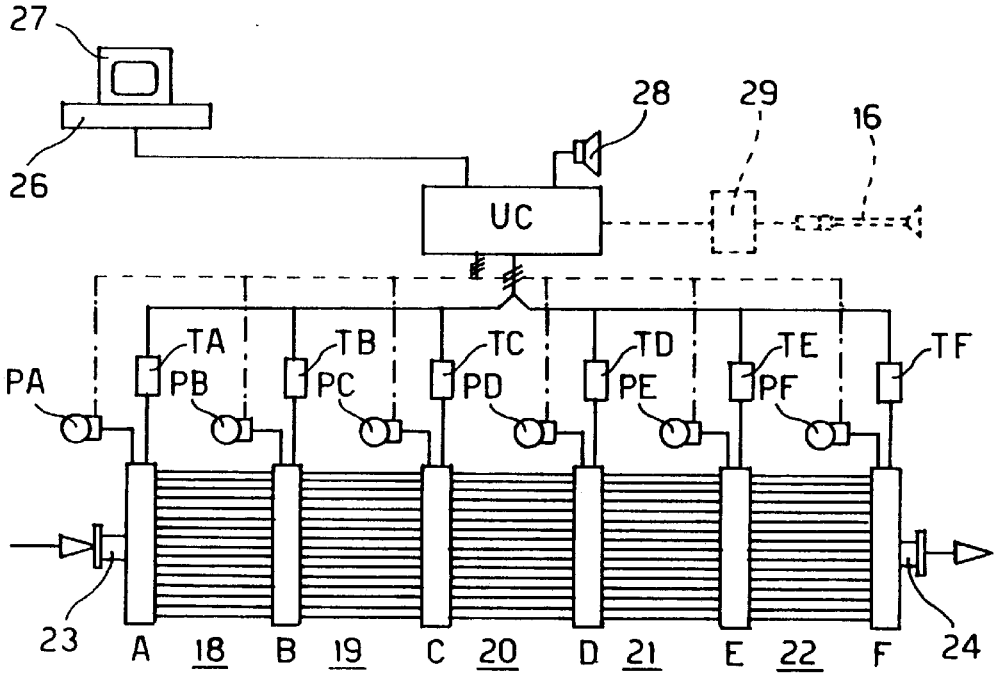
FIG. 3 is a linear scheme showing the connection in series of the different pipe nests by the single header sections.
Figure 4:
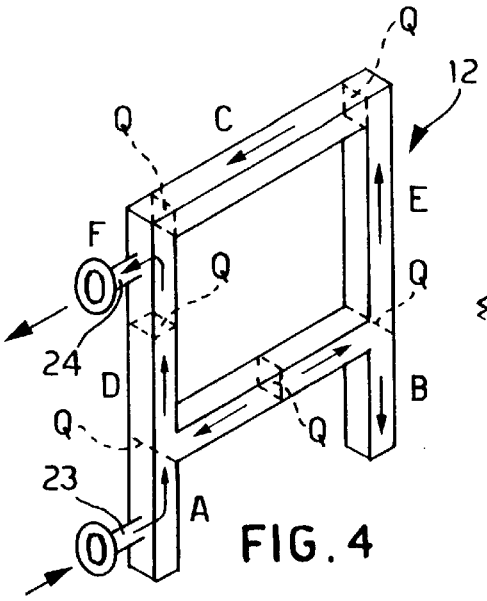
FIG. 4 is a schematic view of the header wherein the fluid flow directions have been depicted.

FIG. 3 of the accompanying drawings shows the typical arrangement of the several pipe nests 18, 19, 20, 21 and 22 and their connection in series through sections A, B, C, D, E and F of the header 12.

According to a feature of the present invention, this particular design of the pipe system for the diathermic fluid circulation, and their connection in series by a front header having several sections, allows for the installation in each single section of the header, of suitable temperature and pressure sensing devices or means, by which the regular circulation of the diathermic fluid can be monitored in each single circuit. It will be therefore possible to immediately detect and prevent dangerous resistance and/or obstructions for the diathermic oil flow, caused by a local overheating of the pipe nests, with possible fluid cracking, identifying the header sections involved and localising the pipe nest wherein the cracking phenomenon or the fault is occurring.

Figure 10:
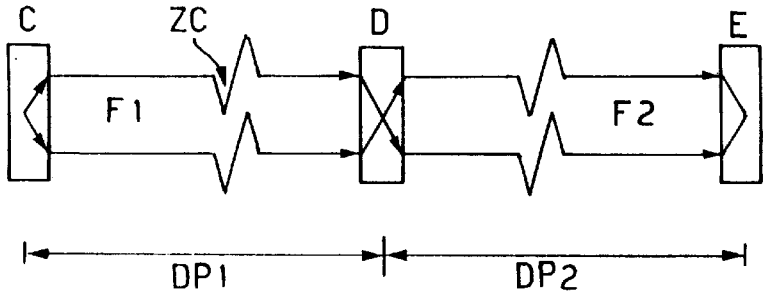
FIG. 10 is a scheme of the circuit of two pipe nests connected in series, each one being constituted by two pipes parallely arranged and connected to the respective header sections.
Figure 11:
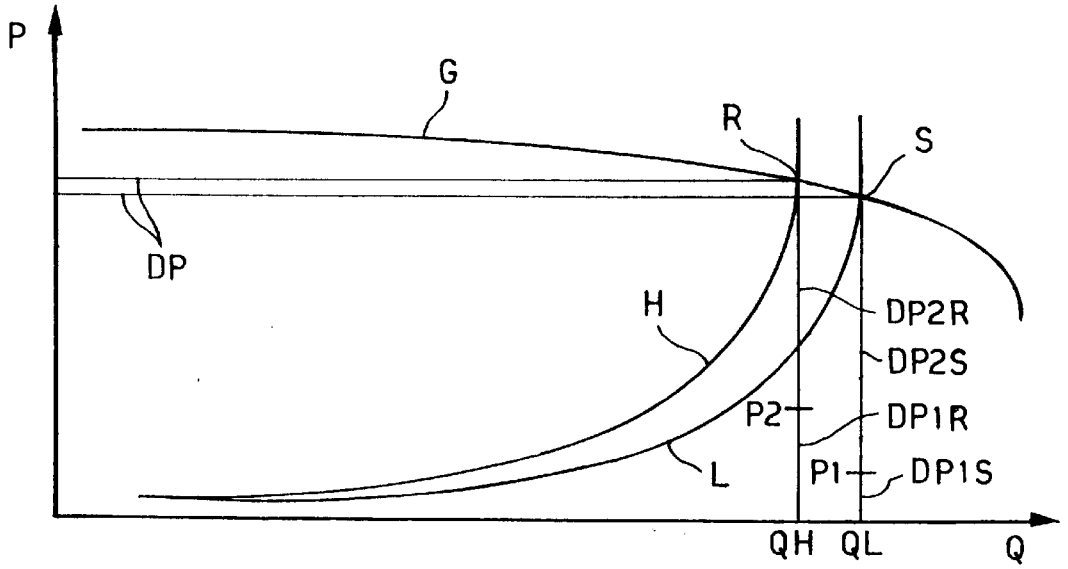
FIG. 11 shows the pressure diagram as a function of the flow, which is indicative of the behaviour of the two circuits of FIG. 10 during a cracking phenomenon in one of the pipe of the first circuit.
Figure 12:
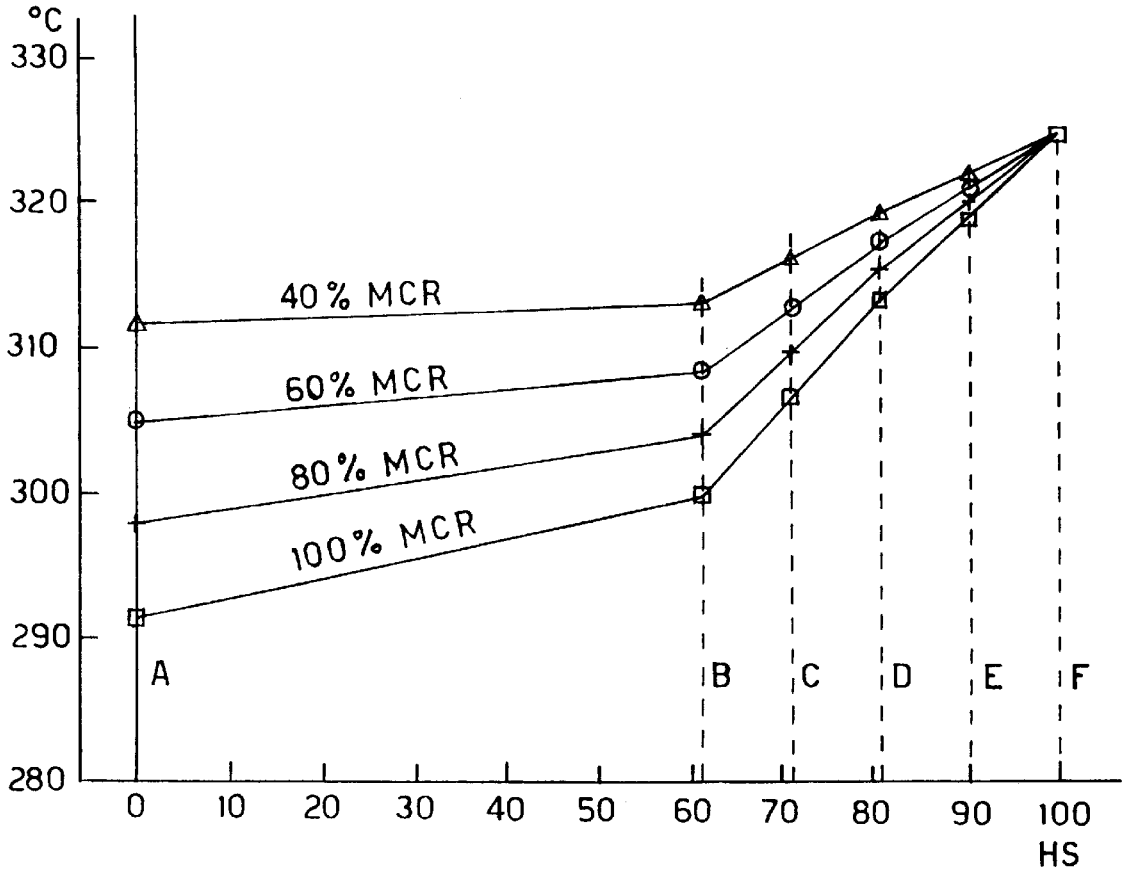
FIG. 12 is a diagram indicative of the oil temperatures along the pipe nests for different thermal flow conditions.

What above can be better understood with reference to FIG. 3 and to the illustrative schemes of FIGS. 10, 11 and 12.

A simple measurement of the pressure drop between the inlet fitting and the outlet fitting of the header has been considered insufficient to supply useful information, because of the limited sensibility of any pressure switch to detect a small increase in load losses and therefore a small reduction in the fluid flow. Moreover, a simple measurement of the pressure drop between inlet and outlet sides of the heater does not allow to distinguish whether an increase of the pressure drop is caused by oil cracking for partial plugging of the pipe, by a variation of the density of the oil flowing in the generator, due for example to a flame temperature variation, or by other causes;

moreover it is not possible to localize the circuit plugging. Therefore the solution comprises a monitoring system, for detecting, in a continuous way or at predetermined intervals, any differential pressure drop and fluid temperature of each circuit provided by each of the pipe nests 18–22.

According to a first aspect of the invention, therefore, pressure detectors are provided in each header section, and more particularly a pressure detector PA in the inlet section A, a pressure detector PF in the outlet section F, as well as single pressure detectors PB, PC, PD and PE in the respective intermediate sections B, C, D and E of the header 12.

Similarly, the same number of temperature detectors are provided, TA for the inlet section A of the header, TF for the outlet section F and TB, TC, TD and TE for the intermediate sections B, C, D and E respectively. All pressure sensors and all temperature sensors are connected to respective inlet ports of a central control unity UC suitably programmed to manage the control of the thermal fluid circulation. Therefore this central control unity will be connected, by an interface 26 to a monitor 27 for supplying all required information, as well as to a possible alarm device 28. Moreover the central control unit UC in turn can be connected to a local control unit 29 managing the operation of the burner 16.

The differential control of the pressure can be carried out in the following way: in the operating condition, such as with all pipes clean and free from cracking phenomena, the pressure signals provided by the several pressure sensors PA to PF, will move all together in the same direction, that is they will increase or decrease contemporaneously. At a certain point, should a cracking or plugging start in a pipe of one of the nest circuits, the system will cause:

1. a remarkable increase of the pressure drop in the circuit wherein a pipe is cracking;
2. a very small increase of the pressure drop between the inlet section A and the outlet section F of the header; and
3. a slight decrease of the pressure drop in the circuits not directly involved in the cracking event, due to the general flow decrease because of the reduction of the fluid passage in the cracking section.

A better illustration of what above, is given with reference to FIGS. 10 and 11 which represent the characteristic behaviour of two circuits in series, for example the circuits comprised between the header sections C and D and respectively D and E, each one being constituted for example by two parallel pipes, after starting of the cracking in point ZC of one of the pipes of the first circuit.

From pressures P and flows Q diagram of FIG. 11, it can be noted that if G indicates the characteristic curve of pressure P referred to the flow Q, typical of the fluid circulation pump; L indicates the flow losses curve of the circuit without cracking, H indicates the corresponding curve of the flow loss with cracking; it will be seen that the equilibrium point of the pump operation and of the circuit in the two conditions (with or without cracking) will be indicated respectively by S and R; in the same figure DP1S and DP1R indicate the pressure drops of the two pipe nests in series F1 and F2 at the flow QL relating to point S, while DP1R and DP2R indicate the pressure drops always in the same two circuits F1 and F2 at the flow QH relating to point R. Therefore, against a small increase DP on the pump curve G, from S to R, in the first pipe nest F1, a consequent higher increase of the pressure drop DP1S—DP1R will occur, passing from curve L to curve H. In this way the differential pressure variation may be easily detected by the relevant sensors, between the header sections C and D.

In order to confirm the above approach, some experiments have been performed simulating cracking, thus carrying out a set of tests.

Cracking and plugging were simulated in one pipe of the circuit, by a pneumatically actuated valve, having an electro-pneumatic positioner, provided on a pipe of the last circuit in series. The fluid used was water at ambient temperature, fed from a tank at a level five meter height from the soil to maintain a constant suction pressure for the circulation pump.

A continuous detection and recording of the flow and pressure was provided for the pump, as well for the power consumption.

By means of electric signals sent to the valve converter, the partial or total plugging of the pipe was simulated.

In particular, a first pressure detector was positioned on the circuit directly involved in the cracking simulation, one on a circuit not involved in the cracking simulation, and another one between the header inlet and outlet.

A flow meter-transmitter magnetic device was provided on the pipe involved in the cracking simulation.

The control signals from the transmitters were analysed as really generated from a cracking situation, after filtration of the electrical noise to evaluate the disturbs coming for example by mechanical vibrations.

The tests fully confirmed the expected results: the differential pressure on each multi-tubular circuit or pipe nest of the generator resulted to be a very sensible signal and also capable to detect a plugging at its starting in any pipe; even a 15% plugging on a pipe resulted remarkably.

In the meantime, after plugging simulation, the differential pressure between the generator inlet and outlet slightly increased, while the differential pressure of any other circuit slightly decreased.

The pump fitted to the new conditions setting to a new working pressure confirming the behaviour expected in the diagram of FIG. 11.

If by the selective control of the pressure drops in each circuit of the pipe nests it is possible to verify any resistance or obstructions already in the starting phase of cracking, by the selective detection of the fluid temperatures in the different circuits in series, in turn, it is much more possible to verify localized overheating situations, due for example to a bad operation of the burner, which inevitably would cause defects in the diathermic fluid circulation. The selective control of the temperatures also allows an initial danger signal of cracking anticipating the intervention of the differential pressure switches.

According to another aspect of the invention, therefore it has been used a system of temperature detecting-transmitting devices, positioned in the several sections of the front header of the generator, which was able to continuously supply information on every variation of the temperature parameter with respect to a suitably set up reference rising curve of the temperatures along the diathermic fluid path.

The profiles of the temperature curves introduced into the control unity UC, processed by the interface PC with the operator, assumes for each thermal load condition the aspect of the diagram of FIG. 12; therefore any deviation from these temperature profiles, will cause an alarm signal to the operator and an indication of the necessary intervention by a dedicated diagnostic software.

From these tests and from theoretical calculation, it resulted that by the continuous comparison of the various differential pressures and of the temperatures is therefore suitable to detect initial cracking conditions of the diathermic fluid, adding in this way an active safety device.

Figure 13:
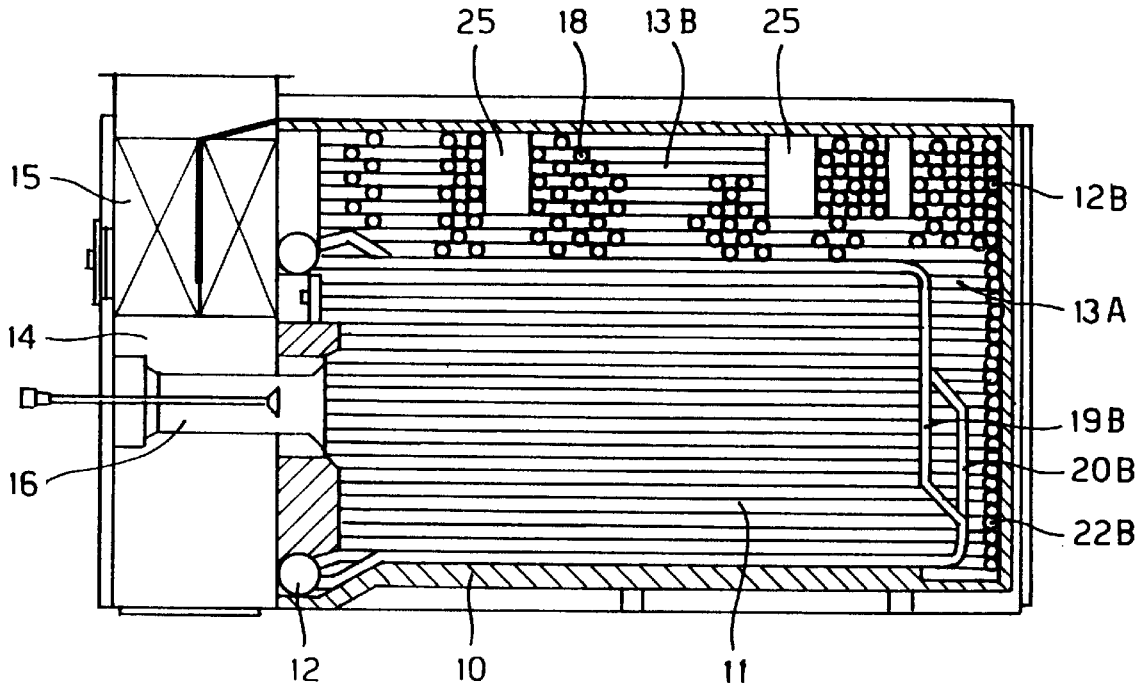
FIG. 13 is a longitudinal sectional view of the heat generator with the convection pipe nest provided over the combustion chamber.

With reference now to FIG. 13, it is shown a longitudinal section of the heat generator according to the invention, wherein path 13B of the flue gas is positioned over the combustion chamber 11 in such a way to facilitate the access to the same chamber for maintenance purposes. Therefore in FIG. 13 the same reference numbers have been used to indicate similar parts of the generator of FIG. 1.

Figure 14:
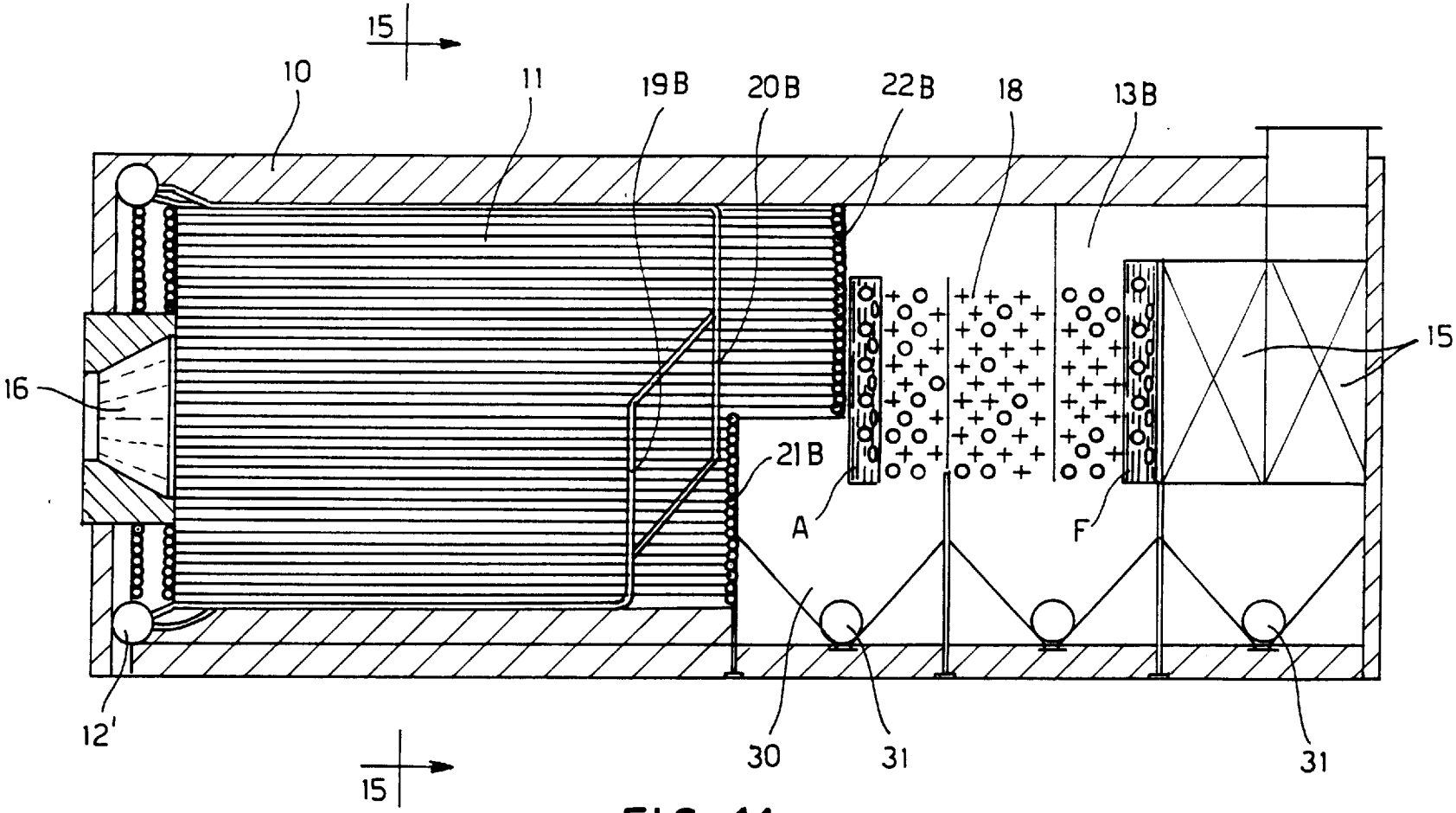
FIG. 14 is a longitudinal sectional view of the heat generator with convection pipe nest rearwardly provided to the combustion chamber.

FIG. 14 shows, on the contrary, a rear disposition of the convection pipe nest 18, of the inlet header section A, of an auxiliary header section F for connecting the convection nest to the radiation pipe nests, and of the flue gas path, maintaining the front arrangement of the main header section 12', and the connection in series of the pipe nests according to the scheme of FIG. 3. Therefore, also in FIG. 14 the same reference numbers of FIGS. 1 and 13 have been used for similar or corresponding parts. From said FIG. 14 it can be noted that rear lengths 21B and 22B of the pipes defining the rear wall of the combustion chamber, have been spaced apart to allow the flue gas passage toward the rear path 13B where the flue gas are conveyed by internal partitions along a sinusoidal path, along which the dust entrained by the flue gas is trapped and collected in underlying hoppers 30, where it is periodically removed by any suitable system, for example by motor driven Archimedean screws 31.

As previously referred, the oil circulation in the combustion chamber and consequently the arrangement of the pipe nests 19, 20, 21, and 22 have been designed to allow for the detection of a possible incorrect orientation of the burner flame. This can be explained with reference to FIGS. 15 and 16 of the accompanying drawings.

Figure 15:
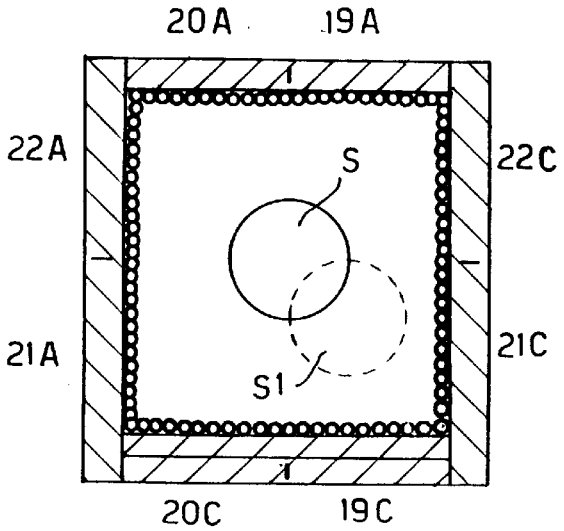
FIGS. 15 and 16 are two cross-sectional views of the combustion chamber along line 15—15 of FIG. 14, showing possible incorrect flame inclinations of the burner, in the heat generator according to the invention.
Figure 16:
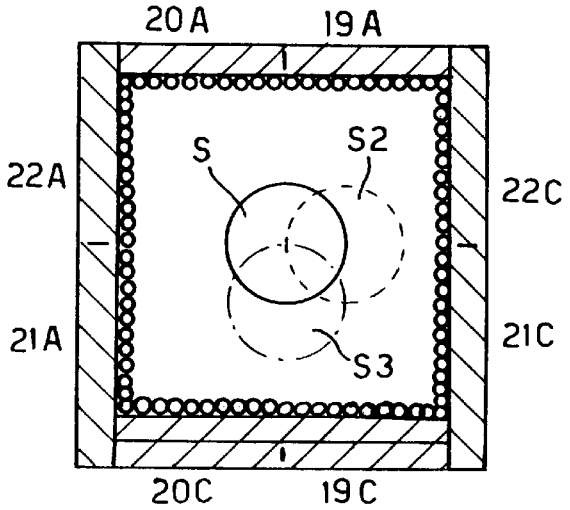

In FIG. 15, the circle S indicates the central position of the flame of the burner, where the pipe nests are radiated in a homogeneous way, while reference S1 indicates a disposition at 45° of the flame, laterally and downwardly oriented, where it causes a greater thermal stress for circuits 19A, 19C and 21A, 21C; otherwise in FIG. 16, reference S2 indicates a first lateral orientation of the flame on one side where the flame prevalently stresses the circuits 19A and 19C, as well as S3 indicates a downwardly oriented flame where the flame prevalently stresses the circuits 21A and 21C. The different orientation of the flame may be therefore detected by the respective temperature probes provided for the single sections of the header.

From what above said and shown, it will be therefore clear that a heat generator has been provided of a particular conception, by which it is possible to control the operative status of each pipe nest for the diathermic fluid circulation. A similar heat generator is suitable for many applications: in particular it is advantageously applicable in substitution of the conventional vertical coils employed for example in plant for the production of synthetic fibres and yarns.

However, it is intended that what above said and shown with reference to the accompanying drawings, has been given only as an example of the general features of the invention and that other modifications and changes may be carried out in the shape and in the structure of the front header, in the design and arrangement of the pipe nests or in other parts of the generator, without departing from the general principles of the invention.

What is claimed is:

1. A diathermic fluid heat generator comprising a combustion chamber having inner walls, a conveying path for the combustion gas from the combustion chamber, and a fluid distribution header for circulation of the diathermic fluid along a set of pipe nests in the combustion chamber and in said gas conveying path, said fluid distribution header comprising a fluid inlet and outlet and interval partitions to divide the same header into a plurality of tubular header sections at which said pipe nests are connected to, wherein said fluid distribution header comprises a main header unit at the front part of the combustion chamber, having an annular form, the pipe nests in said gas conveying path being connected in series to the pipe nests of the inner walls of the combustion chamber and to the fluid inlet, through tubular sections of said header; and control means are provided for controlling the fluid circulation in the pipe nests of the combustion chamber said control means comprising temperature detecting devices for detecting the fluid temperature in each tubular section of the header, and an electronic control unit fed by temperature control signals from each of said temperature detecting devices, said control unit being programmed to detect a variation of the fluid temperature in each header section, comparing the same with at least a set of temperature reference values stored in the control unit relative to a specific thermal load of the heat generator, to provide a control signal for a burner of the heat generator, and/or for an alarm.

2. A heat generator according to claim 1, wherein said control means for controlling the fluid circulation further comprise pressure detecting devices for detecting the fluid pressure in each tubular section of the header, and in that said electronic control unit is fed by the pressure control signals from each pressure detecting device, said control unit being programmed to detect a variation of the differential pressure value between two adjacent header sections of the header with respect to a pressure reference value stored in the control unit to provide a control signal for the burner and/or for the alarm.

3. A heat generator according to claim 1 wherein said control unit is programmed to detect the temperature and/or pressure values of the fluid in the header sections in a continuous way or at predetermined times.

4. A heat generator according to claim 1 wherein it comprises an air preheater connected to the conveying path of the combustion gas, built-in at the front portion of the heat generator.

5. A heat generator according to claim 1 wherein the pipe nests defining the combustion chamber comprise at least superimposed first and second pipe nests defining the roof wall the rear wall and the bottom wall of the combustion chamber, and at least a first and a second pipe nests defining the side walls of the combustion chamber, and in which the diathermic fluid is reversely flowing in said first pipe nests in respect to said second pipe nests of the combustion chamber walls.

6. A heat generator according to claim 5, wherein the pipes of said first and second pipe nests of the rear wall of the combustion chamber are differently shaped for allowing the passage of the combustion gas toward gas conveying path.

7. A heat generator according to claim 5, wherein the pipes of said first and second pipe nests, defining the side walls of the combustion chamber, are beyond the rear wall to define a back screening wall for the gas conveying path.

8. A heat generator according to claim 5, wherein the pipes of said pipe nests, are inwardly bent to define a screening wall for the combustion chamber, near the front header.

9. A heat generator according to claim 1, wherein said control unity is programmed to supply alarm signals respectively control signals to a separated control unit for the burner operation.

10. A heat generator according to claim 1 wherein said pipe nests are connected to and are freely extending from said front header.

11. A heat generator according to claim 10, wherein the pipe nests in the gas conveying path are bent in the form of horizontal coils, and are overlapped and offset each other for self-supporting the same pipe nests.

12. A heat generator according to claim 10, wherein at least in an intermediate area of the pipe nests in said gas conveying path some superimposed coil ranks are spaced apart from one another.

13. A heat generator according to claim 1 wherein the gas conveying path and the corresponding pipe nests are positioned under the combustion chamber.

14. A heat generator according to claim 1 wherein the gas conveying path and the corresponding pipe nests are positioned over the combustion chamber.

15. Heat generator according to claim 1 wherein the gas conveying path and the corresponding pipe nests are positioned rearwardly to the combustion chamber.

16. A heat generator according to claim 1 wherein the inlet header section, the outlet header section and the annular shaped main header section are in the form of an integrated header, wherein the inlet header section and a portion of an intermediate section of the main header, protrude from a side.

17. A heat generator according to claim 1 wherein said main annular header is provided at the front side of the combustion chamber, and wherein the inlet header section, and auxiliary header section for the connection tube nests of the gas conveying path with the combustion chamber pipe nests are structurally separated from said main annular header and are disposed into a gas conveying path rearwardly positioned to the combustion chamber.

* * * * *